US011521436B2

(12) United States Patent
Fischer et al.

(10) Patent No.: US 11,521,436 B2
(45) Date of Patent: Dec. 6, 2022

(54) METHOD AND CONTROL UNIT FOR DETECTING A DAMAGE TO A VEHICLE

(71) Applicant: Robert Bosch GmbH, Stuttgart (DE)

(72) Inventors: Yannick Fischer, Ludwigsburg (DE); Michael Schmid, Kornwestheim (DE); Simon Koenig, Moeckmuehl (DE)

(73) Assignee: Robert Bosch GmbH, Stuttgart (DE)

( * ) Notice: Subject to any disclaimer, the term of this patent is extended or adjusted under 35 U.S.C. 154(b) by 177 days.

(21) Appl. No.: 17/034,768

(22) Filed: Sep. 28, 2020

(65) Prior Publication Data

US 2021/0174613 A1 Jun. 10, 2021

(30) Foreign Application Priority Data

Dec. 5, 2019 (DE) ..... 102019218951.2

(51) Int. Cl.
*G07C 5/08* (2006.01)

(52) U.S. Cl.
CPC ..... *G07C 5/0808* (2013.01)

(58) Field of Classification Search
CPC .. G07C 5/0808; G07C 5/0841; B60R 21/0136
See application file for complete search history.

(56) References Cited

U.S. PATENT DOCUMENTS 9,019,092 B1 * 4/2015 Brandmaier ..... B60R 21/0136 340/436
11,062,605 B1 * 7/2021 McFarland, Jr. ..... G06V 20/56
2017/0236340 A1 * 8/2017 Hagan, Jr. ..... G07C 5/008 701/31.7
2019/0279440 A1 * 9/2019 Ricci ..... H04W 4/48
2019/0279447 A1 * 9/2019 Ricci ..... G06Q 20/145

* cited by examiner

*Primary Examiner* — Joseph J Dallo
(74) *Attorney, Agent, or Firm* — Norton Rose Fulbright US LLP; Gerard Messina

(57) ABSTRACT

A method for detecting a damage to a vehicle. The method includes a reading-in step and an evaluation step. In the reading-in step, a body sensor signal is read in via an interface to a body sensor of the vehicle, the body sensor signal representing at least one body vibration recorded in the body area. A chassis sensor signal is furthermore read in via an interface to a chassis sensor of the vehicle, which represents at least one chassis vibration recorded in the chassis area. In the evaluation step, the body sensor signal and the chassis sensor signal are evaluated to obtain an evaluation result representing the damage.

10 Claims, 3 Drawing Sheets

METHOD AND CONTROL UNIT FOR DETECTING A DAMAGE TO A VEHICLE

CROSS REFERENCE

The present application claims the benefit under 35 U.S.C. § 119 of German Patent Application No. DE 102019218951.2 filed on Dec. 5, 2019, which is expressly incorporated herein by reference in its entirety.

FIELD

The present invention is directed to a method and a control unit for detecting a damage to a vehicle. A computer program is also the subject matter of the present invention.

BACKGROUND INFORMATION

Airbag control units including corresponding sensors are used to detect safety-relevant accidents. It would further be favorable to be able to detect damage to the vehicle preferably at an early point in time to be able to eliminate the damage and/or operate the vehicle in a protected mode.

SUMMARY

In accordance with an example embodiment of the present invention, an improved method is provided for detecting a damage to a vehicle, as well as an improved control unit which uses this method, and finally a corresponding computer program. The measures described herein make advantageous refinements of and improvements on the example device in accordance with the present invention described herein possible.

Due to the approach presented here, an option is provided, for example, to detect minor damage to the vehicle using technically simple means, which are usually already available as standard in the vehicle.

A safety may be advantageously increased or ensured thereby for at least one occupant of the vehicle.

In accordance with an example embodiment of the present invention, a method for detecting a damage to a vehicle is provided, which includes a reading-in step and an evaluation step. In the reading-in step, a body sensor signal is read in via an interface to a body sensor of the vehicle. The body sensor signal represents at least one body vibration recorded in the body area. A chassis sensor signal is furthermore read in via an interface to a chassis sensor of the vehicle, which represents at least one chassis vibration recorded in the chassis area. In the evaluation step, the body sensor signal and the chassis sensor signal are evaluated to obtain an evaluation result representing the damage.

The example method may be carried out, for example, in a vehicle which is implemented, for example, as a passenger car. The damage may be, for example, a minor damage to a component of the vehicle (for example a door, a rear-mounted or roof-mounted luggage rack or a fender of the vehicle), which is, for example, detectable only with difficulty, but which may render itself conspicuous during vibrations triggered by the driving of the vehicle, due to a characteristic (for example structure-borne) vibration or waveform. The body sensor may be situated, for example in a body of the vehicle and record primarily vibrations which act upon the vehicle via the body due to driving effects, such as wind pressure, stone chip, etc. The chassis sensor may be situated, for example at a chassis of the vehicle and record primarily vibrations which act upon the vehicle via the chassis due to ground properties. Even hard-to-detect damage to the vehicle is advantageously detectable thereby, so that the safety of at least one occupant of the vehicle may be advantageously ensured. A difference between the body sensor signal and the chassis sensor signal, which is, for example, characteristic for the particular damage to the vehicle and which is thus identifiable by evaluating the vibrations detected in the vehicle, may therefore be particularly advantageously detected by evaluating the body sensor signal and the chassis sensor signal. In this way, for example, signals of structure-born noise or acceleration sensors, which are installed for other vehicle safety systems, such as airbag systems, may be used multiple times, by which an additional benefit of these signals may be advantageously implemented without any added complexity.

According to one specific embodiment of the present invention, the chassis sensor signal may be subtracted from the body sensor signal in the evaluation step. This means that the body sensor signal may include, for example the chassis vibration described with the aid of the chassis sensor signal, which is then subtracted from the signal inducing the body sensor signal for the purpose of identifying the specific damage (for example in the body area) and is thus not considered any further. The chassis vibration may be advantageously removed by subtracting the chassis sensor signal for the purpose of ascertaining the damage.

According to one specific embodiment of the present invention, the method may include a step of at least partially suppressing the chassis vibration, using the body sensor signal and additionally or alternatively the chassis sensor signal, if the chassis vibration exceeds a predetermined threshold value, in particular with regard to an amplitude and additionally or alternatively a frequency of the chassis vibration. This means that the vehicle vibration is suppressed, for example if the amplitude and additionally or alternatively the frequency indicates that the corresponding vibration is attributable to a driving situation or a roadway condition, which may be represented, for example, by the threshold value. In this way, effects may be ignored which occur particularly at high driving velocities, due to the effect of driving over the roadway, which, however, do not significantly contribute to the detection of the damage and thus only unnecessarily increase a data processing complexity.

According to one specific embodiment of the present invention, the method may further include a step of preprocessing the body sensor signal and additionally or alternatively the chassis sensor signal prior to the evaluation step. The preprocessing may include, in particular, a filtering of at least one of the signals. A specific embodiment of this type may advantageously limit a focusing of the evaluation of the vibrations to a vibration range highly relevant for the relevant damage to be detected, so that a data processing complexity is also not unnecessarily increased.

According to one specific embodiment of the present invention, the body sensor may be designed as an acoustic sensor and additionally or alternatively as an acceleration sensor. The chassis sensor may further be additionally or alternatively designed as a road noise sensor. Chassis excitations may be advantageously separated from local damage thereby. In addition, sensors may also be used, which are often already installed in the vehicle for other safety systems and thus do not require any significant added complexity in providing the damage detection.

According to one specific embodiment of the present invention, the damage may be detected in the evaluation step, using at least one predetermined signal pattern assigned to a specific damage. A location where the damage is situated may advantageously be detected thereby. Signal conditions of various damage scenarios may also be specifically and uniquely identified by the usually predefined or recorded signal patterns, so that a precise identification or detection of the specifically occurring damage is made possible by a very easy and fast evaluation of the aforementioned signals.

The example methods may be implemented, for example, in software or hardware or in a mixed form of software and hardware, for example in a control unit.

The present invention here also provides a control unit, which is designed to carry out, control or implement the steps of variants of the method according to example embodiments of the present invention, in corresponding devices. This design variant of the present invention in the form of a control unit also makes it possible to achieve the object underlying the present invention rapidly and efficiently.

For this purpose, the control unit may include at least one processing unit for processing signals or data, at least one memory unit for storing signals or data, at least one interface to a sensor or an actuator for reading in sensor signals from the sensor or for outputting control signals to the actuator and/or at least one communication interface for reading in or outputting data, which are embedded in a communication protocol. The processing unit may be, for example a signal processor, a microcontroller or the like, while the memory unit may be a flash memory, an EEPROM or a magnetic memory unit. The communication interface may be designed to read in or output data wirelessly and/or in a hard-wired manner, a communication interface which may read in or output hard-wired data being able to read in these data, for example electrically or optically, from a corresponding data transmission line or output them to a corresponding data transmission line.

In the present case, a control unit may be understood as an electrical device which processes sensor signals and outputs control and/or data signals as a function thereof. The control unit may include an interface which may be implemented in hardware and/or software. In the case of a hardware design, the interfaces may be, for example, part of a so-called system ASIC, which includes various functions of the control unit. It is, however, also possible that the interfaces are independent, integrated circuits or are at least partially made up of discrete components. In the case of a software design, the interfaces may be software modules which are present, for example, on a microcontroller alongside other software modules.

In one advantageous embodiment of the present invention, a control of a method for detecting a damage to a vehicle takes place with the aid of the control unit. For this purpose, the control unit may access sensor signals, such as a body sensor signal, which represents at least one body vibration recorded in the body area, and a chassis sensor signal, which represents at least one chassis vibration recorded in the chassis area. The control takes place via actuators, such as a read-in unit, which is designed to read in the body sensor signal and the chassis sensor signal, and an evaluation unit, which is designed to evaluate the body sensor signal and the chassis sensor signal.

In accordance with the present invention, a computer program product or computer program, including program code, is also advantageous, which may be stored on a machine-readable carrier or memory medium, such as a semiconductor memory, a hard disk memory, or an optical memory, and is used for carrying out, implementing and/or controlling the steps of the method according to one of the specific embodiments described above, in particular when the program product or program is executed on a computer or a device.

Exemplary embodiments of the present invention are illustrated in the figures and explained in greater detail in the description below.

Figure 1:
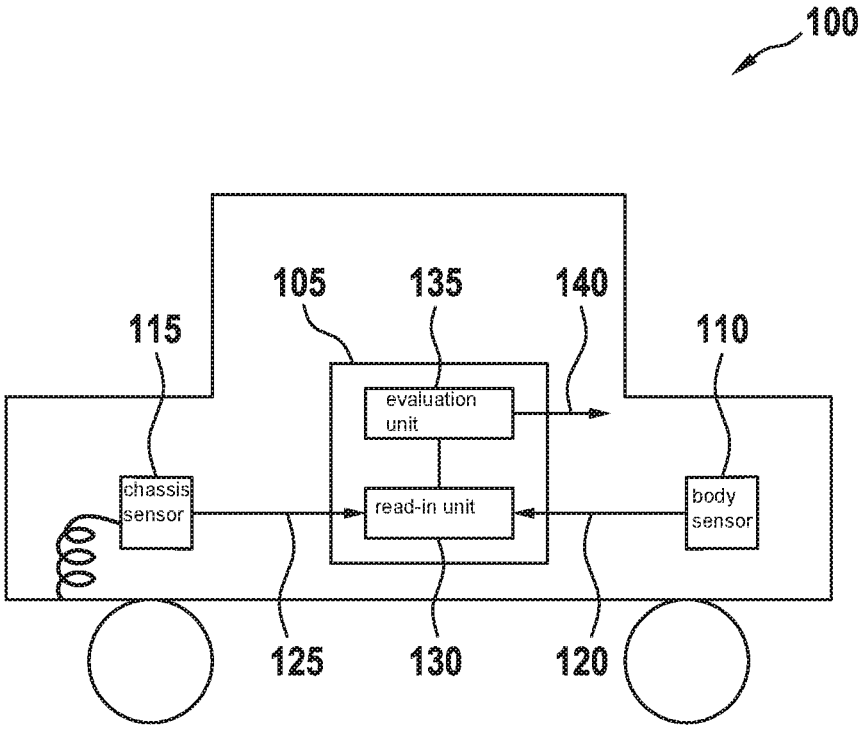
FIG. 1 shows a schematic representation of a vehicle, including a control unit, according to one exemplary embodiment of the present invention.

In the following description of favorable exemplary embodiments of the present invention, identical or similar reference numerals are used for the elements which are illustrated in the various figures and have the same or similar functions, a description of these elements not being described repeatedly.

DETAILED DESCRIPTION OF EXAMPLE EMBODIMENTS

FIG. 1 shows a schematic representation of a vehicle 100, including a control unit 105, according to one exemplary embodiment. Vehicle 100 is implemented, for example, as a passenger car. In addition to control unit 105, vehicle 100 also includes a body sensor 110 and a chassis sensor 115. Device 105 is designed to carry out a method for detecting a damage, in that, for example, it reads in a body sensor signal 120 provided by body sensor 110 and a chassis sensor signal 125 provided by chassis sensor 115. Body sensor signal 120 represents at least one body vibration recorded in the body area. Chassis sensor signal 125 represents at least one chassis vibration recorded in the chassis area. According to this exemplary embodiment, device 105 includes a read-in unit 130 and an evaluation unit 135. Read-in unit 130 is designed to read in body sensor signal 120 and chassis sensor signal 125. Evaluation unit 135 is designed to evaluate body sensor signal 120 and chassis sensor signal 125 and to thereby obtain an evaluation result 140 representing the damage. According to this exemplary embodiment, evaluation result 140 represents the result of a subtraction of chassis sensor signal 125 from body sensor signal 120. Evaluation unit 135 is furthermore optionally designed to detect the damage according to this exemplary embodiment, using a predetermined signal pattern assigned to a specific damage. According to this exemplary embodiment, body sensor 110 is designed as an acoustic sensor and/or an acceleration sensor. Chassis sensor 115 is designed, for example, as a road noise sensor.

In other words, chassis sensor 115 is used for a signal correction to detect the damage. According to this exemplary embodiment, this takes place in view of the fact that less significant damage is often detected only when electrical components are damaged. A detection of less significant damage is useful, however, for different reasons, for example to detect a damage caused to another vehicle, to an object or to a person, for example to avoid hit-and-run incidents or to detect the damage to ego vehicle 100. A detection of this type becomes all the more relevant with the development of autonomous driving as well as the growing car-sharing services. It is therefore sensible to facilitate the detection of a local damage, taking into account the chassis vibration, which is also described as excitation, with the aid of the approach presented here.

According to this exemplary embodiment, a reduction of the influence of the driving situation is thus facilitated. Up to now, the detection was carried out only on the basis of local accelerations or excitations, which are referred to here as body vibration, the chassis vibration had to be accepted as n disturbance variable. Since the body vibration is within a comparable magnitude as the chassis vibration, this results in a significant limitation of the performance of a detection system. This means that body sensor 110, which is also referred to as a noise or acceleration sensor, detects both the local excitation and excitations via the chassis in the vehicle, but is not able to automatically separate them from each other. However, chassis sensor 115, which is also referred to as a road noise sensor, detects only the excitations via the chassis, i.e., the vehicle vibration. According to this exemplary embodiment, chassis excitations and local damage may thus be separated. By comparing the body vibration with the chassis vibration, according to this exemplary embodiment, situations, in which a distinction was not previously possible, are distinguished between a normal driving situation and relevant damage.

Taking chassis sensor 115 into account, a feature is generated, for example, which is independent of chassis vibrations, i.e., the chassis vibration is eliminated from the body vibration or partially eliminated or minimized. Technical implementations may take place according to this exemplary embodiment, in that, for example, chassis sensor signal 125 is subtracted from body sensor signal 120, subtracted from the features derived from the raw signals or, for example, time ranges having a high chassis vibration are suppressed or do not cooperate in a decision or further processing.

Depending on the feature calculation and the particular sensor resolutions, a corresponding preprocessing of one or both signals 120, 125 may optionally be necessary. According to this exemplary embodiment, an improved detection of relevant vehicle damage is possible with the aid of the ascertained feature.

Figure 2:
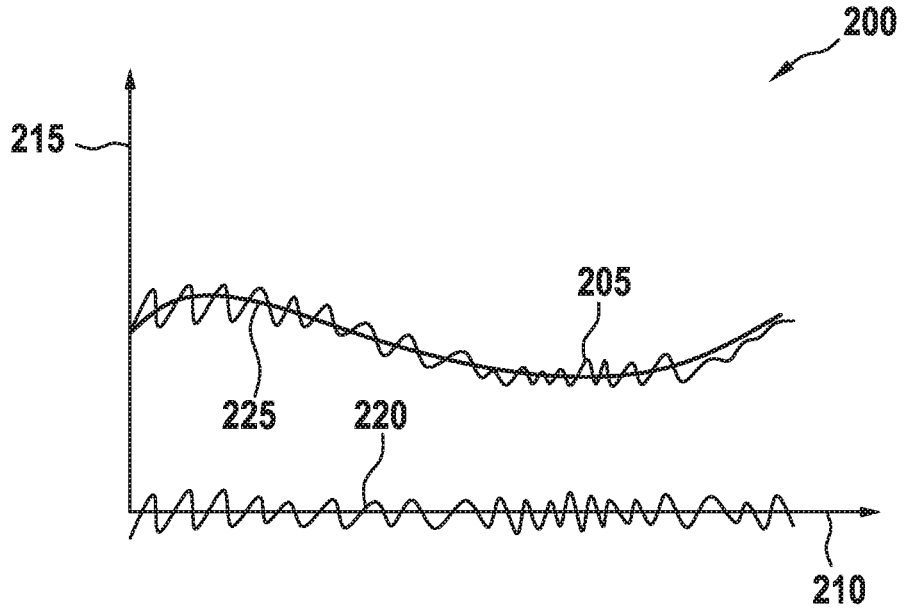
FIG. 2 shows an exemplary embodiment of a vibration diagram of a body sensor signal superimposed by the chassis sensor signal for the purpose of explaining the procedure for detecting a damage to a vehicle in accordance with the present invention.

FIG. 2 shows an exemplary embodiment of a vibration diagram 200 of a body sensor signal superimposed by the chassis sensor signal for the purpose of explaining the procedure for detecting a damage to a vehicle. According to the exemplary embodiment, diagram 200 illustrated here represents body vibration 205 in the form of two overlapping curves. Body vibration 205 may correspond to body vibration 120 mentioned in FIG. 1 and may therefore be evaluated, for example, by a device as described in FIG. 1. According to this exemplary embodiment, an x-axis 210 of diagram 200 represents a time t. A y-axis 215 of diagram 200 represents, for example, an amplitude A. According to this exemplary embodiment, body vibration 205 includes both a high-frequency curve 220 and a curve 225 corresponding to the chassis vibration. According to this exemplary embodiment, high-frequency curve 220 represents the damage to the vehicle, which, however, is superimposed by the chassis signal and is thus not uniquely apparent.

Figure 3:
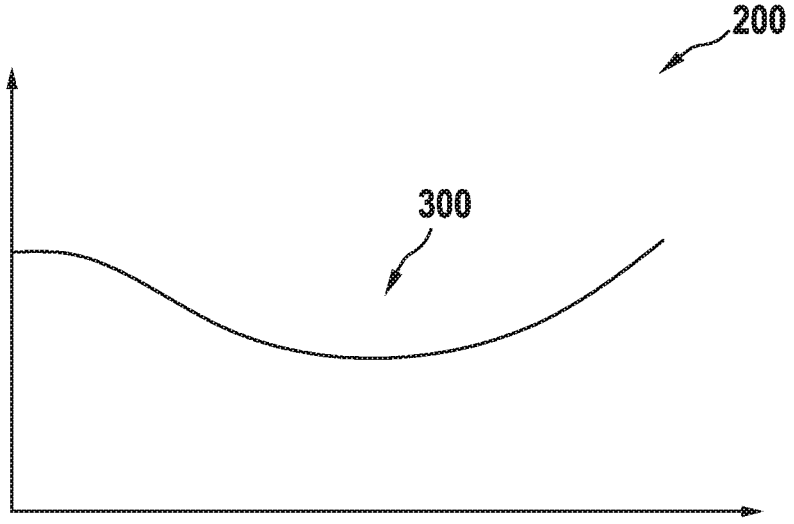
FIG. 3 shows an exemplary embodiment of a vibration diagram of a chassis sensor signal for the purpose of explaining the procedure for detecting a damage to a vehicle in accordance with the present invention.

FIG. 3 shows an exemplary embodiment of a vibration diagram 200 of a chassis sensor signal for the purpose of explaining the procedure for detecting a damage to a vehicle. Diagram 200 illustrated here may correspond to or resemble diagram 200 described in FIG. 2. According to this exemplary embodiment, the only deviation with respect to FIG. 2 is that chassis vibration 300 is illustrated in the form of one curve. The body vibration is not illustrated according to this exemplary embodiment.

In other words, a detection of minor damage in a stationary vehicle is much less serious than in a moving vehicle. In a moving vehicle, accelerations and noises are constantly coupled in via the chassis, depending on the driving situation, the velocity and the roadway paving. Chassis vibration 300 is therefore used as an additional input variable to be able to distinguish local damage from chassis excitations.

Figure 4:
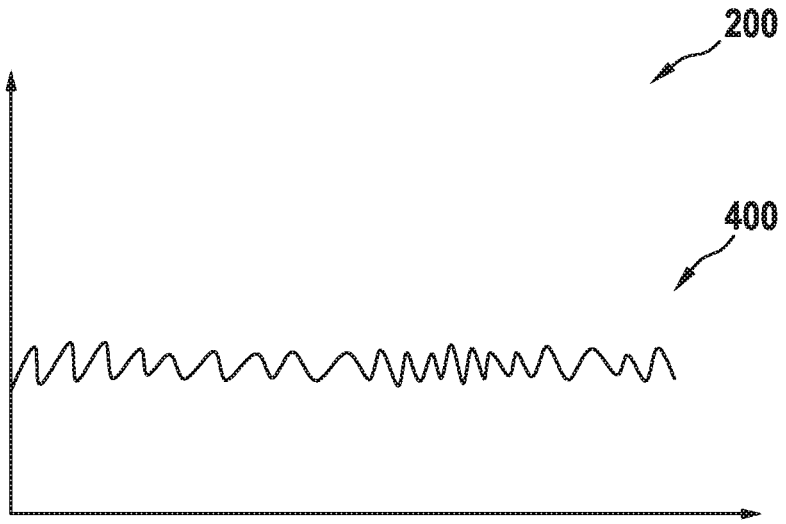
FIG. 4 shows an exemplary embodiment of a vibration diagram of a damage-typical signal profile without any superimposed vibration components from the chassis signal for the purpose of explaining the procedure for detecting a damage to a vehicle in accordance with the present invention.

FIG. 4 shows an exemplary embodiment of a vibration diagram 200 of a damage-typical signal profile without any superimposed vibration components from the chassis signal for the purpose of explaining the procedure for detecting damage to a vehicle. Diagram 200 illustrated here may correspond to or resemble diagram 200 described in FIG. 2 or FIG. 3. According to this exemplary embodiment, the only difference is the evaluation result, i.e. a signal representing the damage, illustrated in the form of a curve 400.

The damage represented by curve 400 may then be compared, for example, with one or multiple signal profile (s) or signal pattern(s), which are not illustrated in the figures and which are each assigned to one specific damage scenario. The damage scenario whose assigned signal profile or signal pattern has the greatest similarity with curve 400 may be ascertained hereby. A greatest similarity of this type may be ascertained, for example, by applying the method of minimizing an average squared error. Signal patterns, which were previously ascertained for the damage to be detected in each case, for example in a laboratory environment, and stored in control unit 105, may be used for the identification or detection of the damage. In this way, a significant improvement of the detection of vehicle damage, and thus the increase in traffic safety, may be achieved with the aid of very simple means by using these signal patterns.

Figure 5:
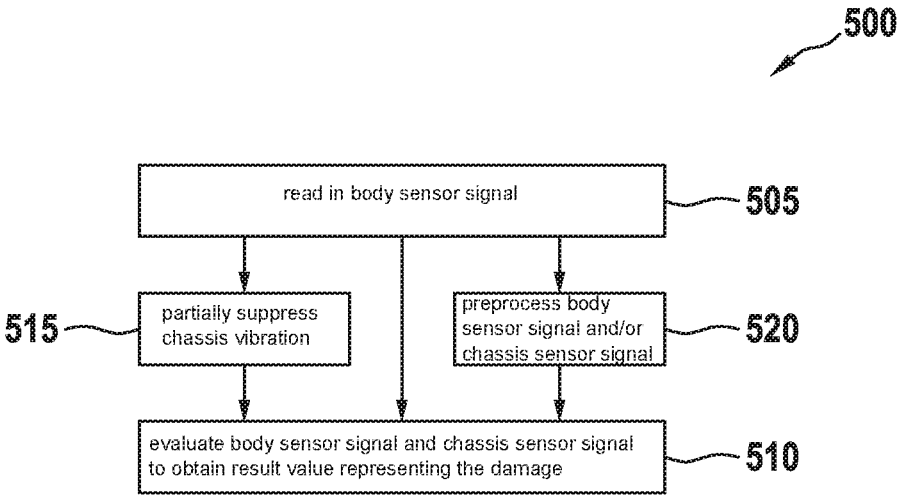
FIG. 5 shows a flowchart of a method for detecting a damage to a vehicle according to one exemplary embodiment of the present invention.

FIG. 5 shows a flowchart of a method 500 for detecting a damage to a vehicle according to one exemplary embodiment.

Method 500 may be carried out by a device as described in FIG. 1. Method 500 includes a reading-in step 505 and an evaluation step 510. In reading-in step 505, a body sensor signal is read in via an interface to a body sensor of the vehicle. The body sensor signal represents at least one body vibration recorded in the body area. In reading-in step 505, a chassis sensor signal is furthermore read in via an interface to a chassis sensor of the vehicle, the chassis sensor signal representing at least one chassis vibration recorded in the chassis area. In evaluation step 510, the body sensor signal and the chassis sensor signal are evaluated to obtain an evaluation result representing the damage.

According to this exemplary embodiment, method 500 only optionally includes a step 515 of at least partially suppressing the chassis vibration, using the body sensor signal and/or the chassis sensor signal if the chassis vibration exceeds a predetermined threshold value, in particular with regard to an amplitude and/or a frequency. According to this exemplary embodiment, method 500 further includes a step 520 of preprocessing the body sensor signal and/or the chassis sensor signal prior to the evaluation step. The preprocessing includes, in particular, a filtering of at least one of the signals.

If an exemplary embodiment includes an "and/or" linkage between a first feature and a second feature, this is to be read in such a way that the exemplary embodiment has both the first feature and the second feature according to one specific embodiment and either only the first feature or only the second feature according to another specific embodiment.

What is claimed is:

1. A method for detecting a damage to a vehicle, the method comprising the following steps:

reading in:

a body sensor signal via an interface to a body sensor of the vehicle, the body sensor signal representing at least one body vibration recorded in a body area of the vehicle; and a chassis sensor signal via an interface to a chassis sensor of the vehicle, the chassis sensor signal representing at least one chassis vibration recorded in a chassis area of the vehicle; and evaluating the body sensor signal and the chassis sensor signal to obtain an evaluation result representing the damage;

wherein the evaluating includes at least one of the following:

subtracting the chassis sensor signal from the body sensor signal; and at least partially suppressing the chassis sensor signal in response to determining that an amplitude or a frequency of the chassis sensor signal is above a predefined threshold.

2. The method as recited in claim 1, wherein the evaluating includes the subtracting of the chassis sensor signal from the body sensor signal.

3. The method as recited in claim 1, wherein the evaluating includes the at least partially suppressing the chassis sensor signal in response to the determining that the amplitude or frequency of the chassis sensor signal is above the predefined threshold.

4. The method as recited in claim 1, further comprising the following step:

preprocessing the body sensor signal and/or the chassis sensor signal prior to the evaluating step, the preprocessing including filtering at least the body sensor signal and/or the chassis sensor signal.

5. The method as recited in claim 1, wherein: (i) the body sensor is an acoustic sensor and/or an acceleration sensor, and/or (ii) the chassis sensor a road noise sensor.

6. The method as recited in claim 1, wherein the damage is detected in the evaluating step, using at least one predetermined signal pattern assigned to a specific damage.

7. A control unit configured to detect a damage to a vehicle, the control unit configured to:

read in:

a body sensor signal via an interface to a body sensor of the vehicle, the body sensor signal representing at least one body vibration recorded in a body area of the vehicle; and a chassis sensor signal via an interface to a chassis sensor of the vehicle, the chassis sensor signal representing at least one chassis vibration recorded in a chassis area of the vehicle; and evaluate the body sensor signal and the chassis sensor signal to obtain an evaluation result representing the damage;

wherein the evaluation includes at least one of the following:

subtracting the chassis sensor signal from the body sensor signal; and at least partially suppressing the chassis sensor signal in response to determining that an amplitude or a frequency of the chassis sensor signal is above a predefined threshold.

8. A non-transitory machine-readable storage medium on which is stored a computer program for detecting a damage to a vehicle, the computer program, when executed by a computer, causing the computer to perform the following steps:

reading in:

a body sensor signal via an interface to a body sensor of the vehicle, the body sensor signal representing at least one body vibration recorded in a body area of the vehicle; and a chassis sensor signal via an interface to a chassis sensor of the vehicle, the chassis sensor signal representing at least one chassis vibration recorded in a chassis area of the vehicle; and evaluating the body sensor signal and the chassis sensor signal to obtain an evaluation result representing the damage;

wherein the evaluating includes at least one of the following:

subtracting the chassis sensor signal from the body sensor signal; and at least partially suppressing the chassis sensor signal in response to determining that an amplitude or a frequency of the chassis sensor signal is above a predefined threshold.

9. The method as recited in claim 2, wherein the body sensor signal is generated by a measurement performed by the body sensor concurrently with a measurement by the chassis sensor by which the chassis sensor signal is generated by the chassis sensor.

10. The method as recited in claim 3, wherein the body sensor signal is generated by a measurement performed by the body sensor concurrently with a measurement by the chassis sensor by which the chassis sensor signal is generated by the chassis sensor.

* * * * *